US010997858B2

(12) United States Patent
Adireddy

(10) Patent No.: US 10,997,858 B2
(45) Date of Patent: May 4, 2021

(54) SYSTEM AND METHOD FOR DETERMINING PARKING OCCUPANCY DETECTION USING A HEAT MAP

(71) Applicant: Continental Automotive Systems, Inc., Auburn Hills, MI (US)

(72) Inventor: Ganesh Adireddy, Bloomfield Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 16/736,068

(22) Filed: Jan. 7, 2020

(65) Prior Publication Data

US 2020/0219393 A1 Jul. 9, 2020

Related U.S. Application Data

(60) Provisional application No. 62/789,786, filed on Jan. 8, 2019.

(51) Int. Cl.
*G08G 1/14* (2006.01)

(52) U.S. Cl.
CPC ..... *G08G 1/141* (2013.01); *G08G 1/143* (2013.01); *G08G 1/148* (2013.01)

(58) Field of Classification Search
CPC ..... G08G 1/141; G08G 1/143; G08G 1/148
USPC ..... 340/932.2
See application file for complete search history.

(56) References Cited

U.S. PATENT DOCUMENTS

| | | | | |
|---|---|---|---|---|
| 8,484,151 | B1 * | 7/2013 | Lookingbill | G01C 21/3685 706/46 |
| 9,870,707 | B2 * | 1/2018 | Korman | G08G 1/144 |
| 9,911,332 | B1 * | 3/2018 | Dorum | G08G 1/056 |
| 10,354,531 | B1 * | 7/2019 | Bronder | G08G 1/141 |
| 2013/0265419 | A1 | 10/2013 | Bulan et al. | |
| 2014/0195138 | A1 | 7/2014 | Stelzig et al. | |
| 2017/0025008 | A1 | 1/2017 | Gignac et al. | |
| 2017/0150307 | A1 | 5/2017 | Himmelreich et al. | |
| 2017/0267233 | A1 * | 9/2017 | Minster | B62D 15/02 |

OTHER PUBLICATIONS

International Search Report and the Written Opinion of the International Searching Authority dated Apr. 29, 2020 for the counterpart PCT Application No. PCT/2020/012676.

* cited by examiner

*Primary Examiner* — John A Tweel, Jr.

(57) ABSTRACT

A method for determining occupancy of a parking space using a heat map includes receiving sensor data from one or more sensors positioned such that a surface area is within a field of view, the sensor data at least indicating a speed and location of a traffic participant. Generating the heat map based on the traffic participant(s) and determining a heat index associated with each portion of the heat map. Determining a traffic participant is stopping, parking, or leaving a parking space based upon the change of speed movement between, high and low, and moving or parking, heat index portions.

8 Claims, 8 Drawing Sheets

200,200a

10

200,200c

300c

300b

300a

400

| | High Moving Index | Low Moving Index | Low Parking Index | High Parking Index |
|---|---|---|---|---|
| High Moving Index | Driving through parking lot OR Stopped in the drivable area of parking | Probability of parking : + OR Stopping closer to the parking spots | - | - |
| Low Moving Index | Vehicle no longer occupies parking spot Spot available | - | Probability of parking : ++ | - |
| Low Parking Index | - | Probability of Pulling out of parking : ++ | | Probability of parking 100% : Parked Spot Occupied |
| High Parking Index | - | | Probability of Pulling out of parking : + | Still Parked |

Parking

Backing Out

FIG. 4

SYSTEM AND METHOD FOR DETERMINING PARKING OCCUPANCY DETECTION USING A HEAT MAP

CROSS REFERENCE TO RELATED APPLICATIONS

This U.S. patent application claims the benefit of U.S. provisional patent application No. 62/789,786, filed Jan. 8, 2019, which is hereby incorporated by reference.

TECHNICAL FIELD

This disclosure relates to a system and a method for generating a traffic heat map associated with an area, for example, a parking area.

BACKGROUND

Traffic on roads and parking areas includes traffic participants, such as, but not limited to, vehicles, streetcars, buses, pedestrians, and any other moving object using public roads and walkways or stationary objects such as benches and trash cans. Organized traffic generally has well established priorities, lanes, right-of-way, and traffic control intersections. However, in addition parking areas may have movement patterns that are not part of typically established right of ways, e.g. vehicles or pedestrians my cut across marked parking spaces. Traffic may be classified by type: heavy motor vehicle (e.g., car and truck), other vehicle (e.g., moped and bicycle), and pedestrian. It is desirable to have a system and method for monitoring the traffic to determine whether specific parking spaces within a parking area are occupied.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

One general aspect includes a method for determining occupancy of a parking space using a heat map of a surface area. The method also includes receiving, at a hardware processor, sensor data from one or more sensors in communication with the hardware processor and positioned such that the surface area is within a field of view of the one or more sensors. The method also includes generating, at the hardware processor, the heat map based on the one or more traffic participants and determining a heat index associated with each portion of the heat map. The method also includes receiving, at a hardware processor, sensor data indicating a speed and location of a traffic participant. The method also includes determining a traffic participant is parking when the speed is slowing and the location moves from a high heat index portion to a low heat index portion. The method also includes determining a traffic participant is leaving a parking space when the speed is increasing and the location moves from a low heat index portion to a high heat index portion.

Implementations may include one or more of the following features. The method may include providing an alert to traffic participants proximate to parking area when a traffic participant is leaving a parking space.

The method may include overlaying the heat map over a geographic map of the surface area.

The method may include displaying on the occupied parking spaces in a first manner and unoccupied spaces in a second manner on the heat map overlaying the geographic map.

One general aspect includes a traffic monitoring system for generating a heat map of a surface area. The traffic monitoring system also includes a hardware processor. The system also includes hardware memory in communication with the hardware processor, the hardware memory storing instructions that when executed on the hardware processor cause the hardware processor to perform the following. Receiving, at a hardware processor, sensor data from one or more sensors in communication with the hardware processor and positioned such that the surface area is within a field of view of the one or more sensors. Generating, at the hardware processor, the heat map based on the one or more traffic participants and determining a heat index associated with each portion of the heat map. Receiving, at a hardware processor, sensor data indicating a speed and location of a traffic participant. Determining a traffic participant is parking when the speed is slowing and the location moves from a high heat index portion to a low heat index portion. Determining a traffic participant is leaving a parking space when the speed is increasing and the location moves from a low heat index portion to a high heat index portion.

Implementations may include one or more of the following features. The system may include providing an alert to traffic participants proximate to parking area when a traffic participant is leaving a parking space.

The system may include overlaying the heat map over a geographic map of the surface area.

The system may include displaying on the occupied parking spaces in a first manner and unoccupied spaces in a second manner on the heat map overlaying the geographic map.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification. It should be understood that the detailed description and specific examples, while indicating the preferred embodiment of the disclosure, are intended for purposes of illustration only and are not intended to limit the scope of the disclosure.

DESCRIPTION OF DRAWINGS

FIG. 4 is a schematic view of an exemplary arrangement for determining traffic patterns of an area based on the system shown in FIGS. 1-3C.

Like reference symbols in the various drawings indicate like elements.

DETAILED DESCRIPTION

Autonomous and semi-autonomous driving has been gaining interest in the past few years. To increase transportation safety of autonomous and semi-autonomous vehicles, it is important to have an accurate idea of the infrastructure (i.e., roads, lanes, traffic signs, crosswalks, sidewalks, light posts, buildings, etc.) that is being used by these vehicles, and know the active participants (e.g., vehicles, pedestrians, etc.) using the infrastructure. A vehicle-traffic system as described below quantifies this information as a heat map, which may be used by the autonomous and semi-autonomous vehicles to improve driving accuracy and thus transportation safety.

Figure 1:
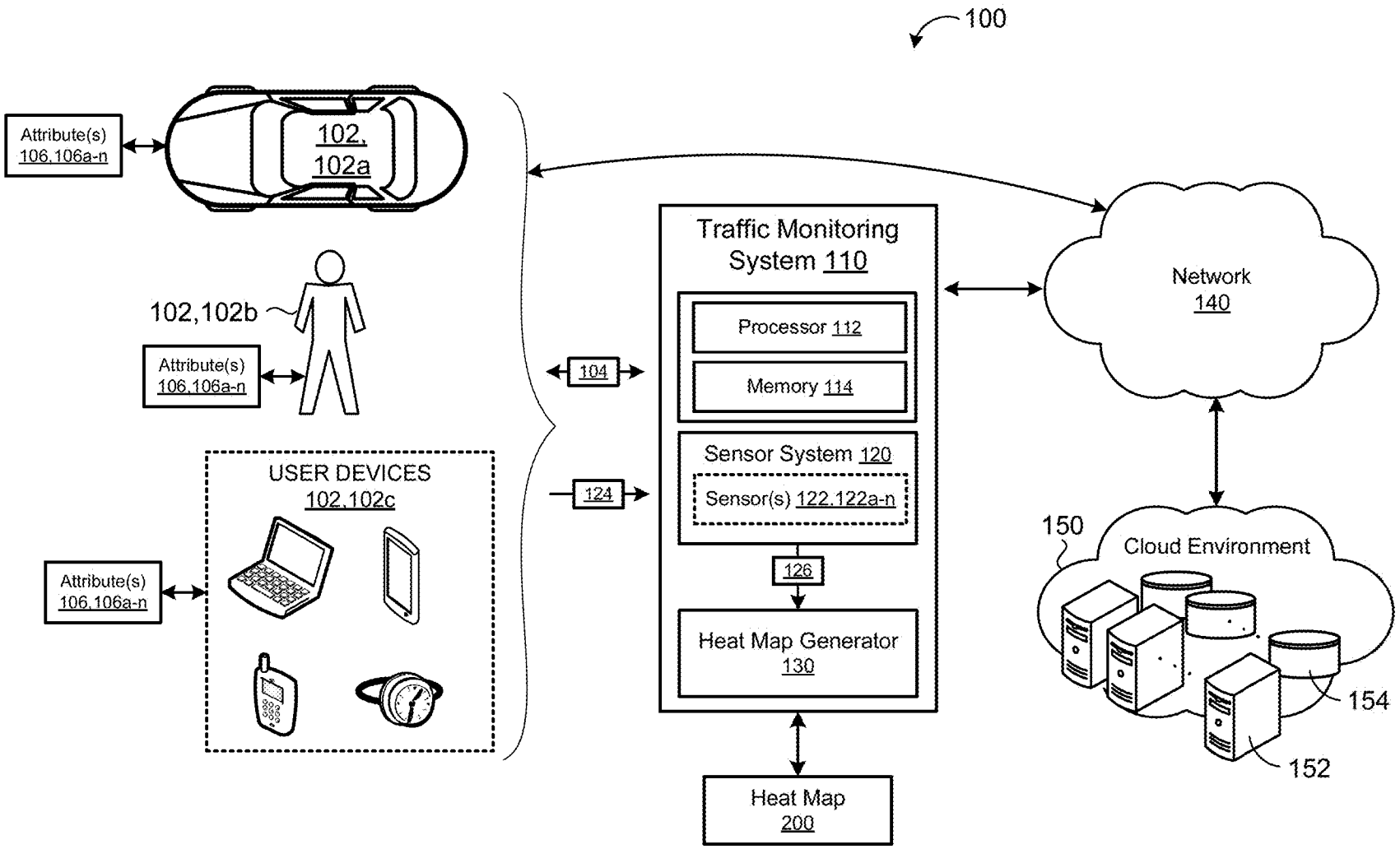
FIG. 1 is a schematic view of an exemplary overview of a vehicle-traffic system.
Figure 2A:
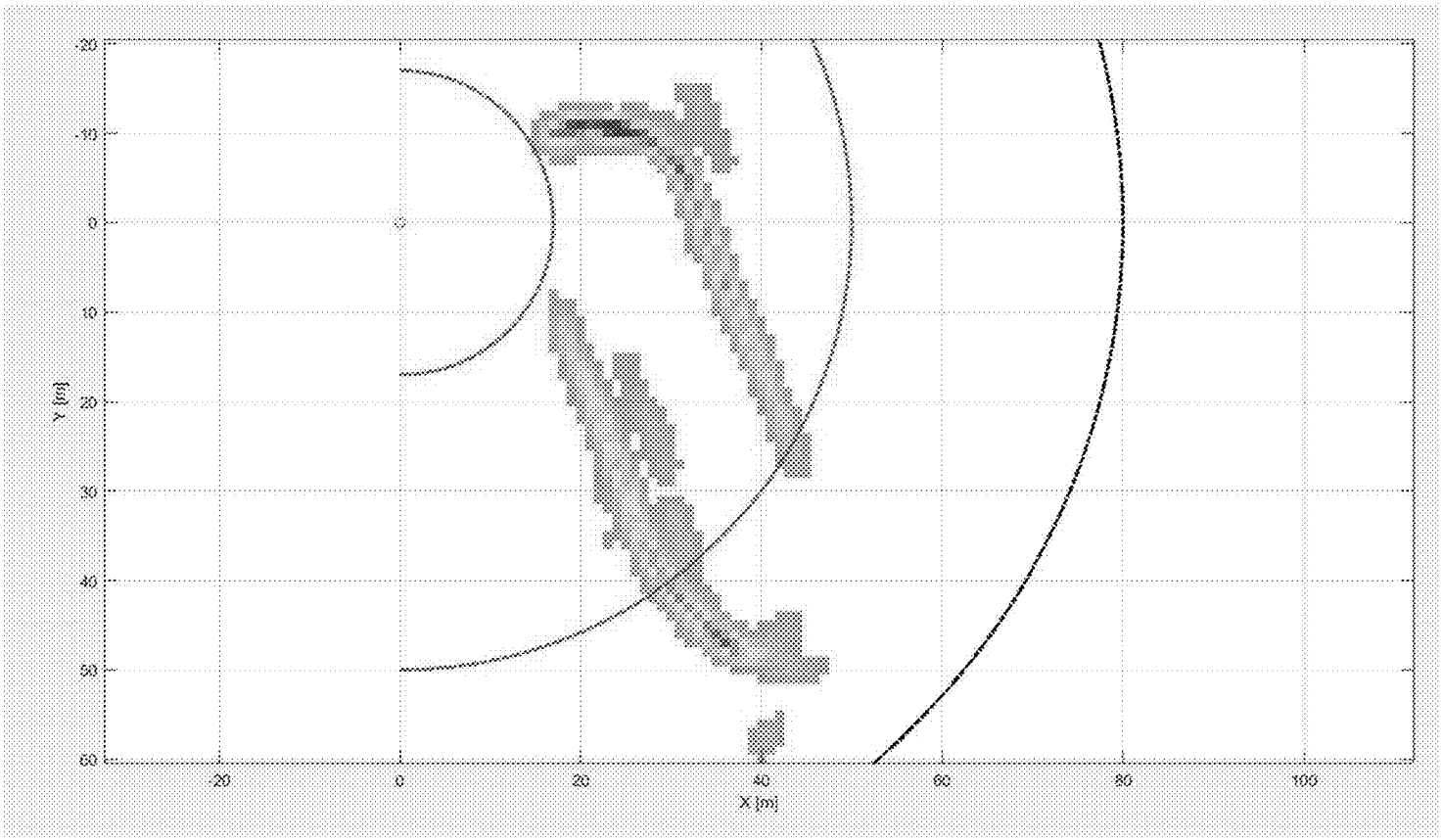
FIG. 2A is a schematic view of an exemplary moving heat map.
Figure 2B:
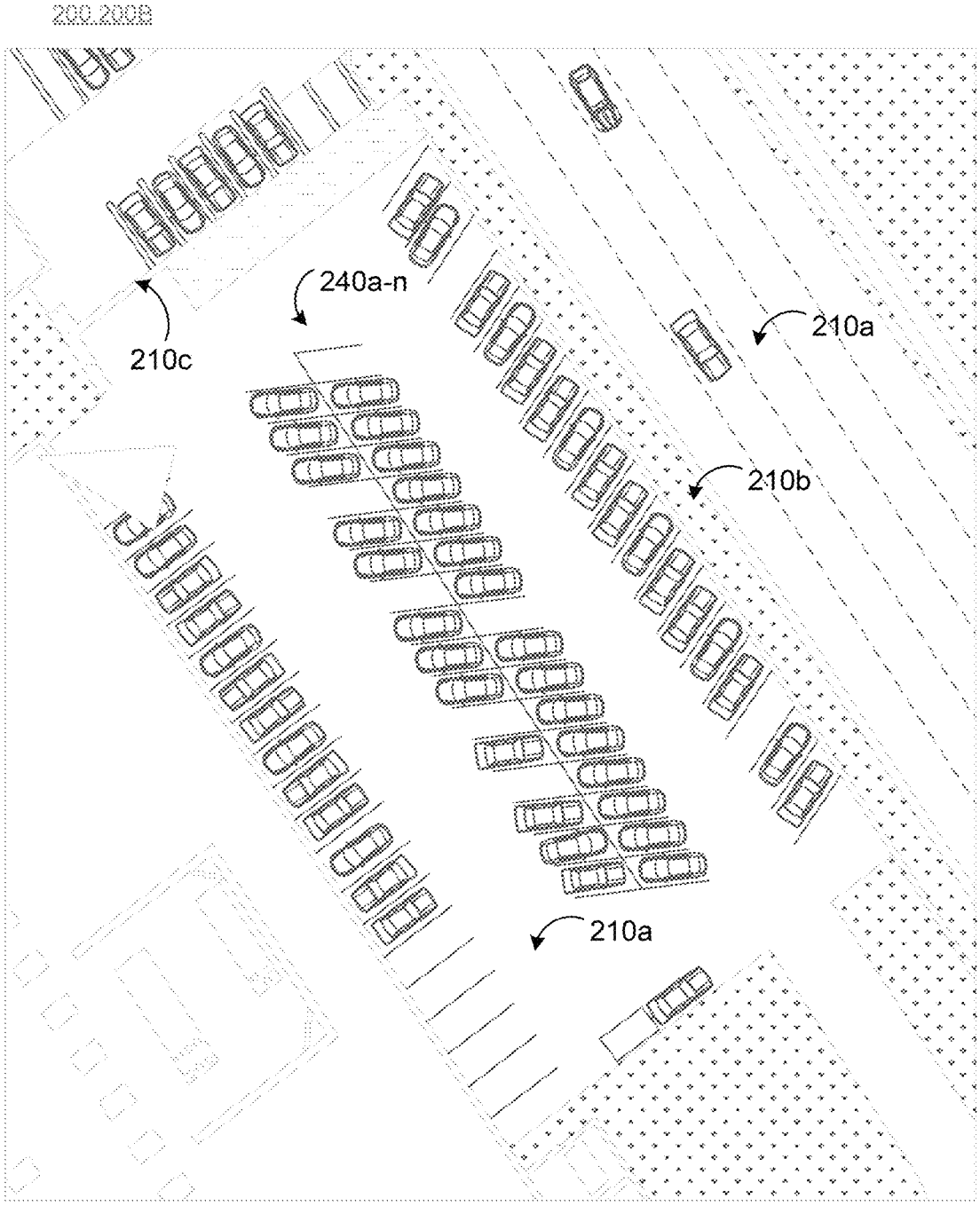
FIG. 2B is a schematic view of an exemplary parking area map based on the area illustrated in FIG. 2A.
Figure 2C:
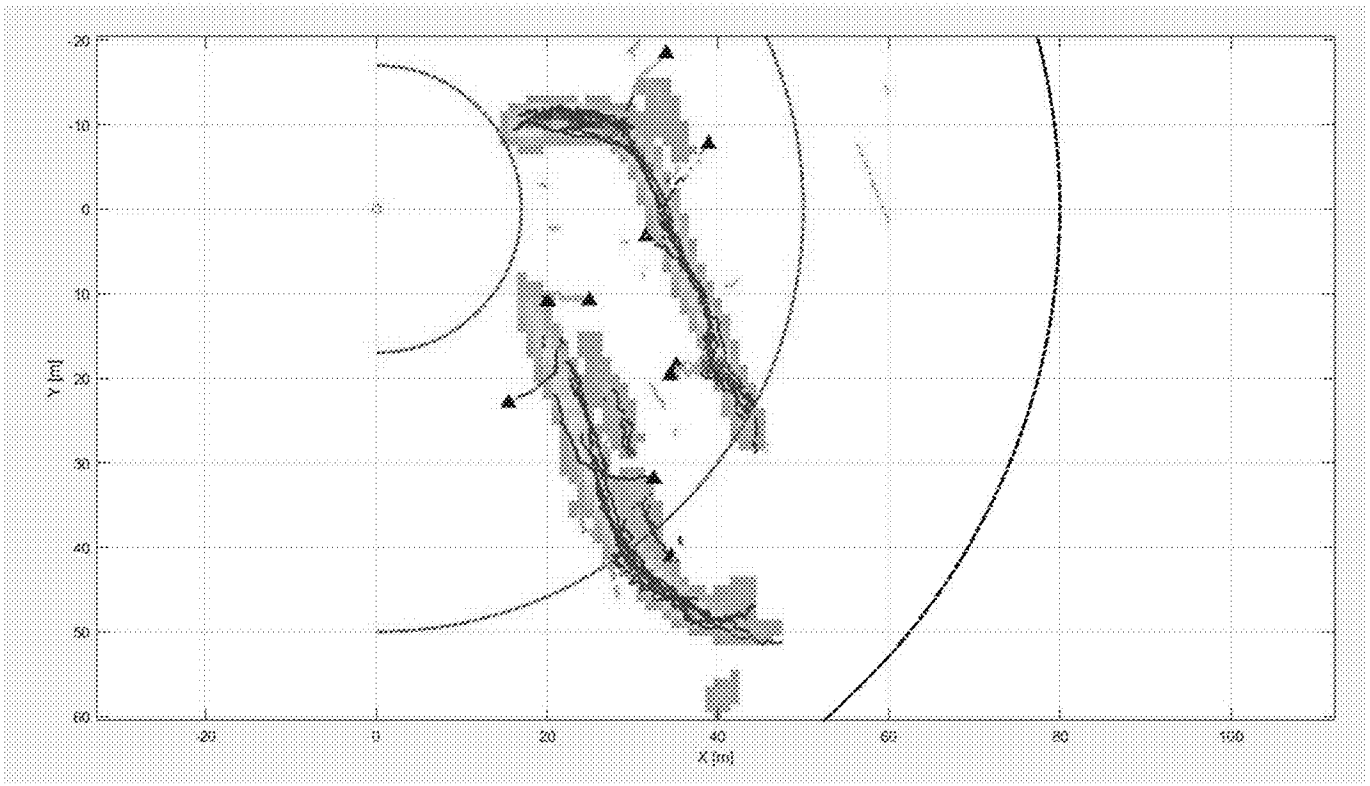
FIG. 2C is a schematic view of an exemplary moving heat map based on the heat map and a geographic map of FIGS. 2A-B.

Referring to FIGS. 1-2C, a vehicle-traffic system 100 includes a traffic monitoring system 110 that includes a computing device (or hardware processor) 112 (e.g., central processing unit having one or more computing processors) in communication with non-transitory memory or hardware memory 114 (e.g., a hard disk, flash memory, random-access memory) capable of storing instructions executable on the computing processor(s) 112. The traffic monitoring system 110 includes a sensor system 120. The sensor system 120 includes one or more sensors 122*a-n* positioned at one or more parking areas 10 and configured to sense one or more traffic participants 102, 102*a-c*. Traffic participants 102, 102*a-c* may include, but are not limited to, vehicles 102*a*, pedestrians and bicyclists 102*b*, user devices 102*c*. In some implementations, the user device 102*c* is any computing device capable of communicating with the sensors 122. The user device 102*c* may include, but is not limited to, a mobile computing device, such as a laptop, a tablet, a smart phone, and a wearable computing device (e.g., headsets and/or watches). The user device 102*c* may also include other computing devices having other form factors, such as a gaming device.

In some implementations, the one or more sensors 122*a-n* may be positioned to capture data 124 associated with a specific area 10, where each sensor 122*a-n* captures data 124 associated with a portion of the area 10. As a result, the sensor data 124 associated with each sensor 122*a-n* includes sensor data 124 associated with the entire area 10. In some examples, the sensors 122*a-n* are positioned within the parking area 10, for example, each sensor 122*a-n* is positioned on a corner of parking area at an adjacent building to view the traffic participants 102 or supported by a light post located in the parking area. The sensors 120 may include, but are not limited to, Radar, Sonar, LIDAR (Light Detection and Ranging, which can entail optical remote sensing that measures properties of scattered light to find range and/or other information of a distant target), HFL (High Flash LIDAR), LADAR (Laser Detection and Ranging), cameras (e.g., monocular camera, binocular camera). Each sensor 120 is positioned at a location where the sensor 120 can capture sensor data 124 associated with the traffic participants 102, 102*a-c* at the specific location. Therefore, the sensor system 120 analyses the sensor data 124 captured by the one or more sensors 122*a-n*. The analysis of the sensor data 124 includes the sensor system 120 identifying one or more traffic participants 102 and determining one or more attributes 106, 106*a-n* associated with each traffic participant 102. The traffic attributes 106, 106*a-n*, may include, but are not limited to, the location of the traffic participant 102 (e.g., in a coordinate system), a speed associated with the traffic participant 102, a type of the traffic participant 102 (e.g., vehicles 102*a*, pedestrians and bicyclists 102*b*, user devices 102*c*), and other attributes of each traffic participant 102 within the area 10.

The traffic monitoring system 110 executes a heat map generator 130 that generates a heat map 200, 200*a*, as shown in FIG. 2A, based on the analyzed sensor data 126 received from the sensor system 120. Therefore, the sensors 122*a-n* capture sensor data 124 associated with an area 10, such as parking area entrances, exits and vehicle pathways between designated parking spaces of the parking area 10, then the sensor system 120 analyses the received sensor data 124. Following, the heat map generator 130 determines a traffic heat map 200*a* of the respective area based on the analyzed sensor data 126. The heat map 200*a* is based on an occurrence of an object or traffic participant 102, 102*a-c* within the specific area 10. As the number of traffic participants 102, 102*a-c* increases within the area 10, a heat-index associated with the area 10 increases as well. As shown in FIG. 2A, a path of each traffic participant 102, 102*a-c* is shown, and the heat-index of each path increases when the number of traffic participants 102, 102*a-c* taking that path increases. No a-priori information about the area 10 is needed by the traffic monitoring system 110 since all relevant information, such as sensor metadata (i.e., sensor location, for example, a relative position of each sensor 122, 122*a-n* in a coordinate system and/or with respect to one another) associated with each sensor 122, 122*a-n* are known and the received sensor data 124 is captured and collected. Therefore, the traffic monitoring system 110 generates the heat map 200*a* to understand the geometry and geography of the area based on the received sensor data 124 associated with each of the sensors 122*a-n*.

Vehicle-to-everything (V2X) communication is the flow of information from a vehicle to any other device, and vice versa. More specifically, V2X is a communication system that includes other types of communication such as, V2I (vehicle-to-infrastructure), V2V (vehicle-to-vehicle), V2P (vehicle-to-pedestrian), V2D (vehicle-to-device), and V2G (vehicle-to-grid). V2X is developed with the vision towards safety, mainly so that the vehicle is aware of its surroundings to help prevent collision of the vehicle with other vehicles or objects. In some implementations, the traffic monitoring system 110 communicates with the traffic participants 102 via V2X by way of a V2X communication 104, and the traffic participant 102 sends one or more attributes of the traffic participant 102 to the traffic monitoring system 110 by way of the V2X communication 104. Therefore, the traffic monitoring system 110 may analyze the V2X communication to determine one or more attributes 106 associated with the respective traffic participant 102.

In some examples, the traffic monitoring system 110 is in communication with a remote system 150 via the network 140. The remote system 150 may be a distributed system (e.g., a cloud environment) having scalable/elastic computing resources 152 and/or storage resources 154. The network 140 may include various types of networks, such as a local area network (LAN), wide area network (WAN), and/or the Internet. In some examples, the traffic monitoring system 110 executes on the remote system 150 and communicates with the sensors 122 via the network 140. In this case, the sensors 122 are positioned at the parking area to capture the sensor data 124. Additionally, in this case, the traffic participants 102 may communicate with the traffic monitoring system 110 via the network 140, such that the traffic participants 102 send the traffic monitoring system 110 one or more attributes 106 associated with the traffic participant 102.

Learning Parking Area Attributes from Sensor Data

In some implementations, the heat map generator 130 learns patterns of traffic participants 102, 102*a-c* based on the analyzed sensor data 126 received from the sensor system 120 (including the attributes 106 associated with each traffic participant 102). Additionally, in some examples, the heat map generator 130 determines a map of the area 10 based on the analyzed sensor data 126. For example, the heat map generator 130 determines a vehicle lane/pathways 210, a pedestrian lane 210*b*, a designated and/or common pedestrian crosswalk, and a plurality of parking spaces 240*a-n* based on an average traffic participant attributes 106 in those lane limits by considering an occupancy probability threshold and cell movement probabilities. The heat map generator 130 may divide the heat map 200*a* into cells, and cell movement is indicative of a traffic participant 102 moving from one cell to another adjacent cell. The heat map generator 130 identifies one or more boundaries, such as a traffic lane 210*a*, a pedestrian lane or a sidewalk 210*b*, a cycling lane (not shown), crosswalk 210*c*, and parking spaces 240*a-n*, etc. based on the received sensor data 124. For example, the traffic monitoring system 110 may determine a boundary to be a traffic lane 210 based on a speed of the traffic participant 102 (e.g., the speed of the traffic participant 102 determined based on the sensor data 124 as one of the participant attributes 106). The heat map generator 130 may consider other factors for determining the type of area boundary 210*a-c*, 240*a-n*. parking area.

Moreover, the heat map generator 130 may identify a boundary as a vehicle lane/pathways 210*a*, a pedestrian lane 210*b*, a designated and/or common pedestrian crosswalk 210*c*, and a plurality of parking spaces 240*a-n* based on the attributes 106 associated with each traffic participant 102. In some examples, the heat map generator 130 identifies the boundary as a sidewalk or a crosswalk 210*c* where the pedestrians walk the most.

In some examples, the heat map generator 130 generates the heat map 200*a* and divides the heat map 200*a* into cells (not shown). Some cells may be associated with cell attributes, such as crosswalk, pedestrian traffic light, cyclist lane, vehicle lane, parking area, or even individual parking spaces.

Based on the received sensor data 124 and the generated heat map 200*a*, the heat map generator 130 may classify the area or parking area 10 as having slow traffic, moderate traffic, or heavy traffic based on its density of traffic participants 102, 102*a-c*.

Generating the Heat Map Based on the Sensor Data

In some implementations, the heat map generator 130 analyses the received sensor data 124, 126 to monitor traffic and generate traffic patterns for the area 10. In addition, the heat map generator 130 may identify a traffic participant 102 as a vehicle 102*a*, a bicyclist or pedestrian 102*b*, or a user device 102*c*, among others. The heat map generator 130 may generate the heat map 200*a* based on the type of traffic participant 102, for example, a vehicle heat map or a pedestrian heat map. The heat map generator 130 may also generate a heat map 200*a* including all traffic participants 102 which shows the classes of traffic participants 102.

In some examples, the traffic monitoring system 110 receives the sensor data 124 and the heat map generator 130 determines an average of the attributes of the moving traffic participants 102 that results in generating the heat map 200*a*, for example a heat map 200*a* associated with each class of traffic participant. Moreover, the heat map generator 130 determines the average (and sigma) speed of each one of the traffic participants 102, the average (and sigma) acceleration of each one of the traffic participants 102, the probability of each one of the traffic participants 102 moving into each adjacent cells, and existing stationary objects to determine the occupancy probability of the traffic participant 102 within each cell.

For the parking lot 10 the heat map is generated using the sensors system 120*a-n* which provide the information on the vehicle(s) which are both moving and stationary in the parking area 10. The information is collected over time and filtered as described herein, to separate the vehicle moving at high relative speed, e.g. V>7 mph, from relative slow-moving vehicles, and stationary vehicles. Using the filter data the heat map 200*a* is generated.

As previously mentioned, the heat map generator 130 may determine a probability of one or more traffic participants 102, 102*a-c* being at the same cell at a certain time. The heat map generator 130 may receive sensor data 124 associated with each traffic participant 102, 102*a-c* and associate attributes to each traffic participants 102. In some examples, the heat map generator 130 stores the received sensor data 124 and/or the analyses sensor data 126 (including the attributes 106) in the hardware memory 114. The heat map generator 130 may then execute a regression model on the hardware processor 112 in communication with the memory 114 to predict the position of each of the traffic participants 102, 102*a-c* in the parking area 10 at a specific time. The regression model may predict the position of the traffic participants 102, 102*a-c* within a cell of the identified grid and or the movement of the traffic participant 102 towards a specific cell or an adjacent cell. The cell-based approach executed by the heat map generator 130 helps in estimating the probability of a traffic participant 102, 102*a-c* moving to an adjacent cell.

Overlaying the Heat Map onto Other Images

In some implementations, the heat map generator 130 generates the heat map 200 based on the sensor data 124 and overlays the heat map 200 on another map, e.g. a captured camera image or schematic illustration of a parking area, to enhance sensor detection and representation of objects resulting in a geographic-heat map 200*c* as shown in FIG. 2C. The traffic monitoring system 110 may use extrinsic calibration parameters associated with the sensors 120 to generate a correspondence matrix between the generated heat map 200*a* and the other types of map/images. For example, the extrinsic calibration parameters associated with the sensors 122 may include the location of each sensor 122 in a coordinate system which may be overlain on the geographic map. As such, the resulting map 200*c* (i.e., the heat map and the other map overlaid) shown in FIG. 2C, provides a better representation of the traffic participants 102, objects (e.g., street lights, trash cans, mail boxes, etc.), vehicle lanes 210*a*, sidewalk 210*b*, and crosswalks 210*c*.

In some examples, the traffic monitoring system 110 identifies a traffic participant 102 and associates a class with the traffic participants 102. For example, vehicles 102*a* are in a different class than pedestrians or bicyclists 102*b*. In some implementations, the heat map generator 130 determines what class a traffic participant 102 belongs to, then the heat map generator 130 can use the generated heat map 200*a* to confirm the class of the traffic participant 102 based on the heat signature of the traffic participant 102.

Once the heat map generator 130 generates the heat map 200*a* from the sensor data 124, the heat map 200 shows what part of the parking area 10 is mostly occupied with which class of traffic participants 102. A probability of a vehicle 102*a* moving in a lane 210*a* is very high whereas a probability of a pedestrian 102*b* in the crosswalk 210*c* is high. In some examples, a new sensor 122 (such as, but not limited to a LIDAR) is added to the sensor system 120, where the new sensor 122 may include a classifier logic for grouping the traffic participants 102 based on their class. The classifier logic may be trained using annotated sensor dataset (i.e., image dataset). Training the classifier logic is generally a labor-intensive task but with knowledge of the heat map 200*a* and the location of a particular class of traffic participant 102 is most likely to be on the map, the sensor data 124 (i.e., image) may be overlaid with the heat map information. This will result in semi-annotation of the images which results in a less labor-intensive classifier logic training.

Overlaying Sensor Data on the Heat Map

While the filtered sensor data is first used to generate the heat map, as described above, once the heat map is established current sensor data can be overlaid on the heat map to detect parking space occupancy, as described herein.

A heat index can be assigned to different areas of the vehicle heat map. A high moving heat index can be used to identify vehicle pathways 210*a* with lots of traffic and/or vehicles moving a higher relative speed, e.g. V=7 mph, where a low heat index could be associated with less traffic and/or lower rates of speed (including V=0), e.g parking spaces 240*a-n*.

The sensor data has information for a specific vehicle 102*a* including the vehicle speed Va, and the location of the vehicle 102*a* on the heat map. By tracking the vehicle position and corresponding heat index the system 10 can determine the following: 1) the vehicle is moving from a high heat index to a low heat index area, the probability of parking increases; 2) the vehicle is slowing and moving to a lower heat index, the probability of parking increases further; and 3) the vehicle comes to stop in a low heat index (plus previous probability of parking), the probability crosses a minimum threshold to determine the vehicle is parked.

Other conclusions may also be drawn by the hardware based on the various data. For example, if the vehicle has slowed or stopped but is still in a high heat index area it may be considered standing, but not parked.

Once the system identifies a vehicle is parked, according to above, the heat map 200 is updated to assign that parking space as being occupied by a parked vehicle. Further, the reverse can also apply. The system 10 can determine when the vehicle is an occupied space is moving (speed increases from Va=0) and the vehicle is moving from the low moving heat index (parking space) to the high heat index (vehicle pathway 210*a*) to determine the parking space is no longer occupied, and the heat map can be updated accordingly.

Overlaying Moving Heat Maps and Parking Heat Maps

Figure 3C:
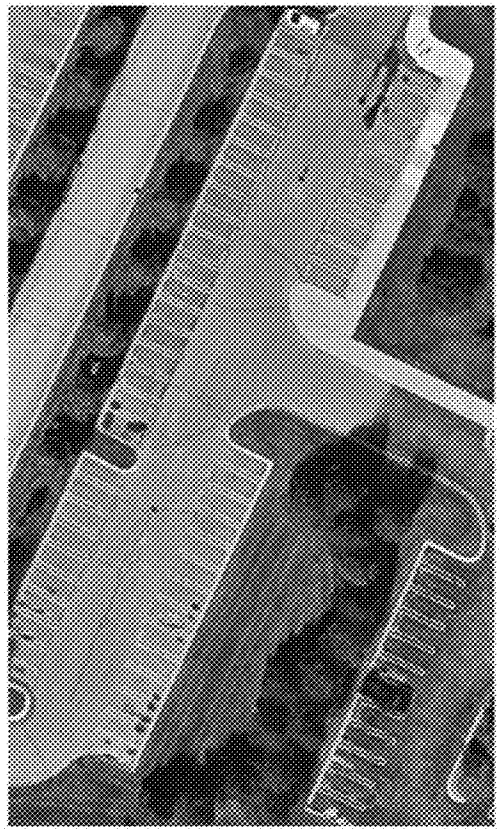
FIG. 3C is a schematic view of an exemplary geographical map based on the moving heat map and the parking heat maps of FIGS. 3A-B.
Figure 3B:
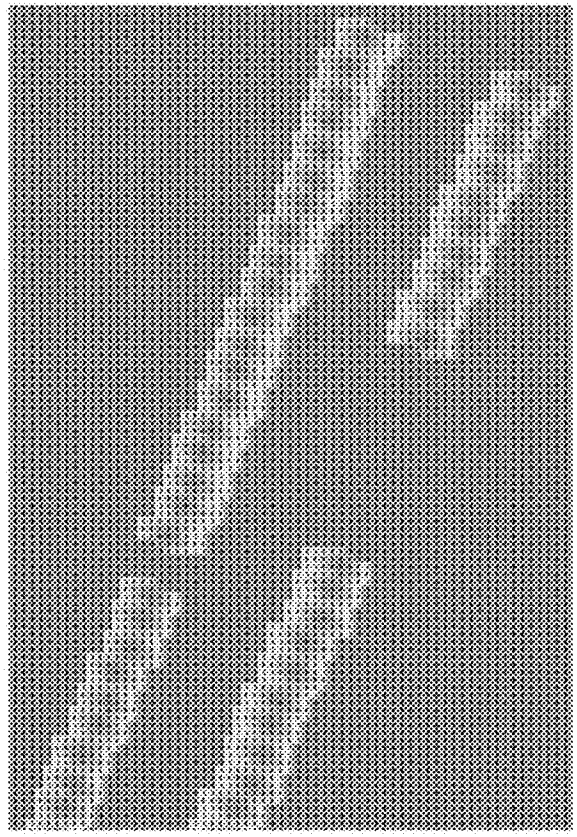
FIG. 3B is a schematic view of an exemplary parking heat map.
Figure 3A:
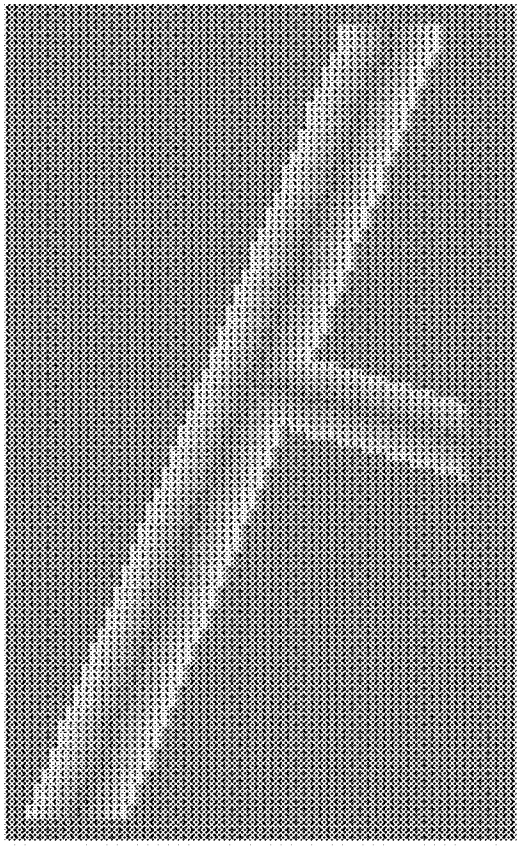
FIG. 3A is a schematic view of another exemplary moving heat map.

FIGS. 3A-C illustrate another embodiment showing a moving heat map 300*a*, parking heat map 300*b*, and a geographic map 300*c*. Also, referring to the schematic illustration of FIG. 4 which illustrates an embodiment 400 for determining a probability that a vehicle is parking, stopping in a driving area, and/or leaving a parking spot. The moving heat map 300*a* and the parking heat map 300*b* may be generated in a similar manner as described above.

By utilizing both a moving heat map 300*a* and a parking heat map 300*b* the system 10 can determine the probability of a vehicle is parking or stopping increases as the vehicle moves from the high moving index to the low moving index. If the vehicle stops in the low moving index the system may conclude that vehicle has stopped in a drivable portion on the parking lot, but has not parked. However, if the vehicle continues to move through the low moving index area toward the high parking index area the system may conclude that the vehicle is parked.

Likewise, when a vehicle is moving from a high parking index to a low moving index the system may determine the vehicle is pulling out of parking space.

As illustrated by the Parking and Backing Out Arrows of FIG. 4 as the vehicle moves from the High Parking Index through the various identified zones toward the High Moving Index the Probability of Backing Out Increases. Alternately, as the vehicle moves from the High Moving Index through the zones to the High Parking Index the Probability of Parking Increases. By combining the Moving Heat Map and the Parking Heat Maps together the system may also determine intermediate situations when a vehicle is not parking and is merely coming to a stop.

Figure 5:
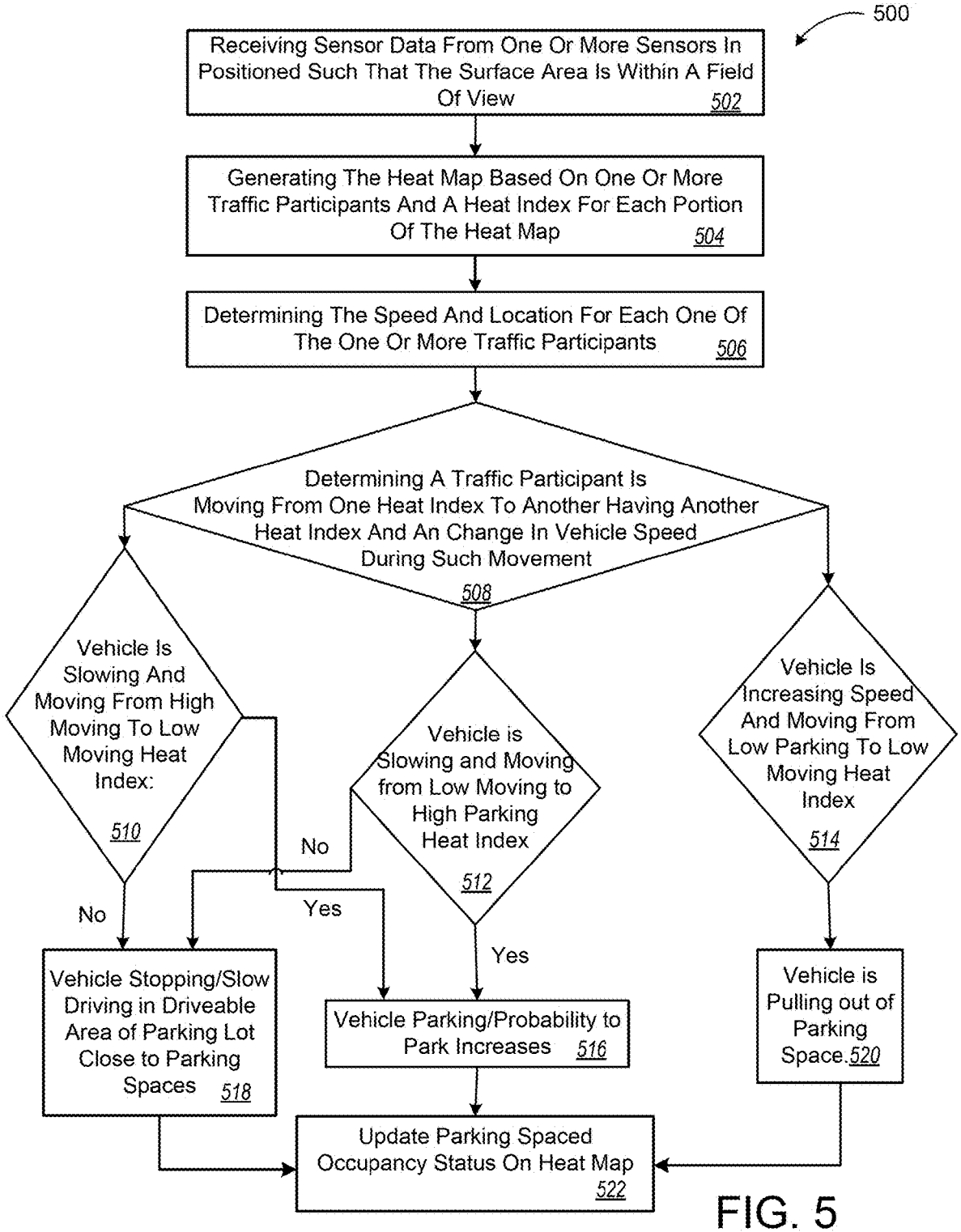
FIG. 5 is a schematic view of another exemplary arrangement of operations for determining traffic patterns of an area based on the system shown in FIGS. 1-3C.

FIG. 5 provides an example arrangement of operations for a method 500 for determining occupancy of a parking space using a heat map of a surface area using the system 100 of FIGS. 1-2C. At block 502, the method 500 includes receiving, at a hardware processor 112, sensor data 124 from one or more sensors 122 in communication with the hardware processor 112 and positioned such that the surface area 10 is within a field of view of the one or more sensors 122. At block 504, the method 500 includes generating, at the hardware processor 112, the heat map 200*a* based on the one or more traffic participants 102, 102*a-c*.

In some implementations, the method 500 also includes identifying areas of the heat map that are indicated as having a high heat index (vehicle pathways) and areas having a low heat index (parking spaces).

Additionally, separate heat maps 200, 200*a* can be generated for moving vehicles 102, 102*a* (moving vehicle heat map; to understand/know where the vehicles move/drive in a parking area) and parking heat map to know where the vehicles park. The parking heat map is created after confidently identifying where the vehicle park. The heat indices of parking heat map will suggest how frequently a parking space 240*a-n* is occupied with respect to other spaces 240*a-n*. Parking heat map over a short duration (e.g. over a few hours) can show, how a parking lot is occupied over that duration (spaces closer to the building occupied first, spaces in shade occupied first, occupancy pattern during morning/evening or winter/summer at a shopping mall). At block 506 the hardware processor 112 determined the speed and location for each of the traffic participants 102, 102*a* (in particular for vehicles).

At block 508 the hardware processor 112 determines that the traffic participant is moving from one heat index to another heat index and that a change in the vehicle speed is occurring at the same time. Block 510 illustrates that the vehicle is slowing and moving from a High Moving Index to a Low Moving Index. If this is TRUE, that system increases the probability that the traffic participant is parking, illustrated at 516. If this is NOT TRUE the system increases the probability that the traffic participant is merely stopping in the drivable area of the parking lot, illustrated at 518.

Block 512 illustrates that the traffic participant is slowing and moving from a Low Moving Heat Index to a High Parking Heat Index. If this is TRUE, the system increases the probability that the traffic participant parking, illustrated at 516. If this is NOT TRUE the system increases the probability that the traffic participant is merely stopping in the drivable area of the parking lot, illustrated at 518.

Further, block 514 illustrates that the traffic participant is increasing speed and moving from a Low Parking Index to a Low Moving Heat Index. If this is TRUE, the system increases the probability that the traffic participants pulling out of the parking space, illustrated at 520.

Therefore, the system determines whether the traffic participant is slowing/stopping 418, parking 516, or pulling out of a parking space 520. Based upon any of these determined actions the heat map 200, 300 is updated by the hardware processor to show the associated parking spaced as occupied/not occupied accordingly.

In some implementations, the method 500 further includes dividing, at the hardware processor 112, the heat map 200*a* into a grid having one or more cells. The method 500 also includes determining, at the hardware processor 112, a probability of one of the traffic participants 102, 102*a-c* in a first cell moving to an adjacent second cell based on a pattern of motion of similar traffic participants.

The method may further include overlaying the heat map 200*a* over a geographic map of the surface area 10 resulting in a geographic-heat map 200*c*. In some examples, overlaying the heat map 200*a* over a geographic map of the surface area 10 includes: receiving, at the hardware processor 112, a sensor geographic location associated with each one of the one or more sensors 122, 122*a-n* from the one or more sensors 122, 122*a-n*; and identifying, at the hardware processor 112, the sensor geographic location of each one of the one or more sensors 122, 122*a-n* on the heat map 200*a* based on the sensor geographic location as a first set of reference points. The method 500 also includes identifying, at the hardware processor 112, the sensor geographic location of each one of the one or more sensors 122, 122*a-n* on the geographic map as a second set of reference points; and overlaying, at the hardware processor 112, the first set of reference points over the second set of reference points resulting in the geographic-heat map 200*c*. In some examples, the method also includes determining, at the hardware processor 112, traffic participant boundaries 210*a-c* based on the heat map 200*a*, where each boundary 210*a-c* identifies traffic lanes 210*a*, crosswalks 210*c*, and/or pedestrian lanes 210*b* of the surface area.

Figure 6:
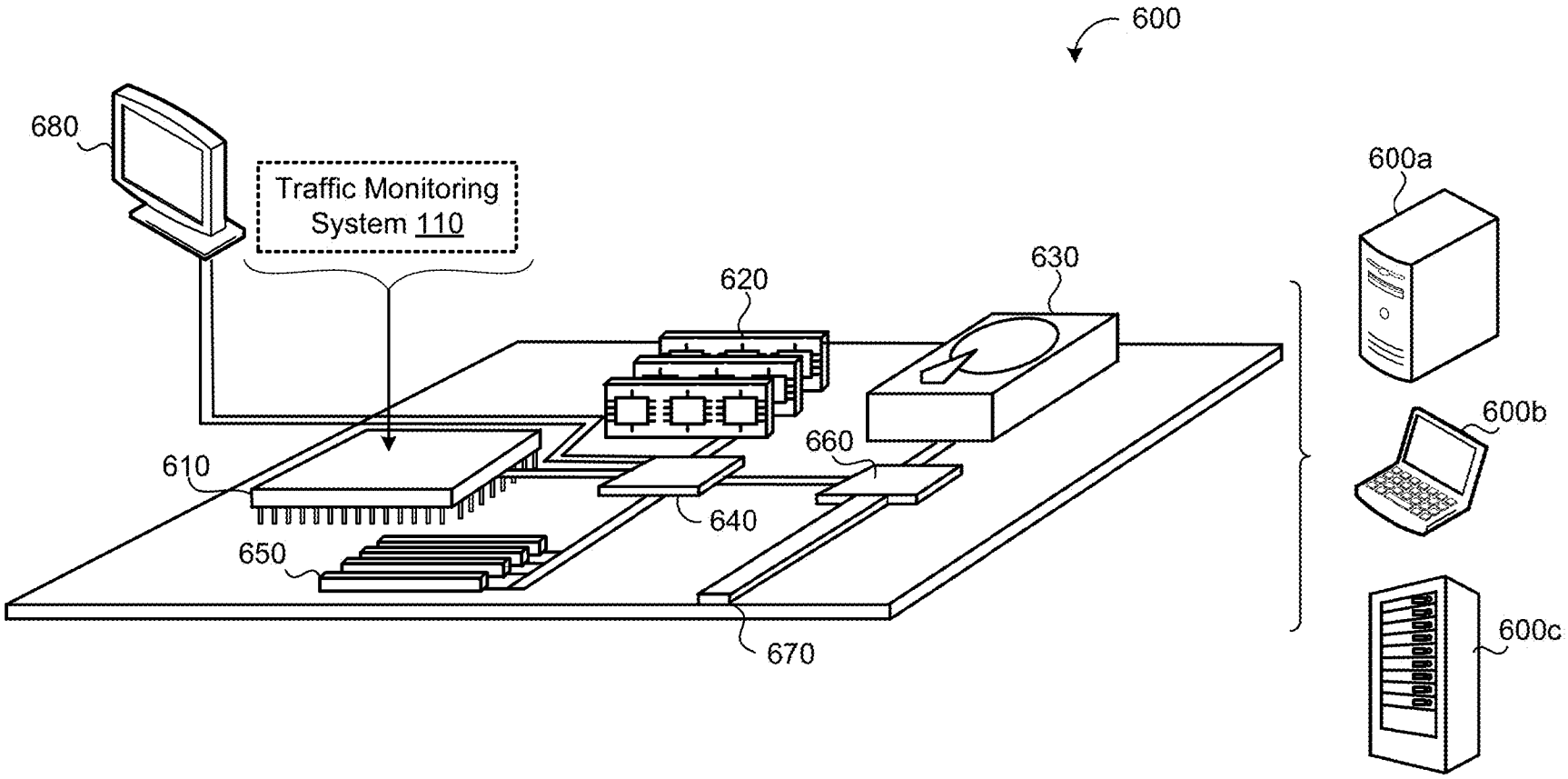
FIG. 6 is a schematic view of an example computing device executing any system or methods described herein.

FIG. 6 is schematic view of an example computing device 600 that may be used to implement the systems and methods described in this document. The computing device 600 is intended to represent various forms of digital computers, such as laptops, desktops, workstations, personal digital assistants, servers, blade servers, mainframes, and other appropriate computers. The components shown here, their connections and relationships, and their functions, are meant to be exemplary only, and are not meant to limit implementations of the inventions described and/or claimed in this document.

The computing device 600 includes a processor 610, memory 620, a storage device 630, a high-speed interface/controller 640 connecting to the memory 620 and high-speed expansion ports 650, and a low speed interface/controller 660 connecting to low speed bus 670 and storage device 630. Each of the components 610, 620, 630, 640, 650, and 660, are interconnected using various busses, and may be mounted on a common motherboard or in other manners as appropriate. The processor 610 can process instructions for execution within the computing device 600, including instructions stored in the memory 620 or on the storage device 630 to display graphical information for a graphical user interface (GUI) on an external input/output device, such as display 680 coupled to high speed interface 640. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 620 stores information non-transitorily within the computing device 600. The memory 620 may be a computer-readable medium, a volatile memory unit(s), or non-volatile memory unit(s). The non-transitory memory 620 may be physical devices used to store programs (e.g., sequences of instructions) or data (e.g., program state information) on a temporary or permanent basis for use by the computing device 600. Examples of non-volatile memory include, but are not limited to, flash memory and read-only memory (ROM)/programmable read-only memory (PROM)/erasable programmable read-only memory (EPROM)/electronically erasable programmable read-only memory (EEPROM) (e.g., typically used for firmware, such as boot programs). Examples of volatile memory include, but are not limited to, random access memory (RAM), dynamic random access memory (DRAM), static random access memory (SRAM), phase change memory (PCM) as well as disks or tapes.

The storage device 630 is capable of providing mass storage for the computing device 600. In some implementations, the storage device 630 is a computer-readable medium. In various different implementations, the storage device 630 may be a floppy disk device, a hard disk device, an optical disk device, or a tape device, a flash memory or other similar solid state memory device, or an array of devices, including devices in a storage area network or other configurations. In additional implementations, a computer program product is tangibly embodied in an information carrier. The computer program product contains instructions that, when executed, perform one or more methods, such as those described above. The information carrier is a computer- or machine-readable medium, such as the memory 620, the storage device 630, or memory on processor 610.

The high-speed controller 640 manages bandwidth-intensive operations for the computing device 600, while the low speed controller 660 manages lower bandwidth-intensive operations. Such allocation of duties is exemplary only. In some implementations, the high-speed controller 640 is coupled to the memory 620, the display 680 (e.g., through a graphics processor or accelerator), and to the high-speed expansion ports 650, which may accept various expansion cards (not shown). In some implementations, the low-speed controller 660 is coupled to the storage device 630 and low-speed expansion port 670. The low-speed expansion port 670, which may include various communication ports (e.g., USB, Bluetooth, Ethernet, wireless Ethernet), may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 600*a* or multiple times in a group of such servers 600*a*, as a laptop computer 600*b*, or as part of a rack server system 600*c*.

Various implementations of the systems and techniques described here can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Moreover, subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The terms "data processing apparatus", "computing device" and "computing processor" encompass all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as an application, program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

One or more aspects of the disclosure can be implemented in a computing system that includes a backend component, e.g., as a data server, or that includes a middleware component, e.g., an application server, or that includes a frontend component, e.g., a client computer having a graphical user interface or a Web browser through which a user can interact with an implementation of the subject matter described in this specification, or any combination of one or more such backend, middleware, or frontend components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A method for determining occupancy of a parking space using a heat map of a surface area, the method comprising:

receiving, at a hardware processor, sensor data from one or more sensors in communication with the hardware processor and positioned such that the surface area is within a field of view of the one or more sensors;

generating, at the hardware processor, the heat map based on one or more traffic participants and determining a heat index associated with each portion of the heat map;

receiving, at a hardware processor, sensor data indicating a speed and location of a traffic participant;

determining a traffic participant is stopping when the speed is slowing and the location moves from a high heat moving index portion to a low moving heat index portion;

determining a traffic participant is parking when the speed is slowing, and the location moves from a low moving heat index portion to a high parking heat index portion; and determining a traffic participant is leaving a parking space when the speed is increasing, and the location moves from a low parking heat index portion to a low moving heat index portion.

2. The method of claim 1, further comprising providing an alert to traffic participants proximate to parking area when a traffic participant is leaving a parking space.

3. The method of claim 1, further comprising overlaying the heat map over a geographic map of the surface area.

4. The method of claim 3, further comprising displaying on the occupied parking spaces in a first manner and unoccupied spaces in a second manner on the heat map overlaying the geographic map.

5. A traffic monitoring system for generating a heat map of a surface area, the system comprising:

a hardware processor; and hardware memory in communication with the hardware processor, the hardware memory storing instructions that when executed on the hardware processor cause the hardware processor to perform operations comprising:

receiving, at a hardware processor, sensor data from one or more sensors in communication with the hardware processor and positioned such that the surface area is within a field of view of the one or more sensors;

generating, at the hardware processor, the heat map based on one or more traffic participants and determining a heat index associated with each portion of the heat map;

receiving, at a hardware processor, sensor data indicating a speed and location of a traffic participant;

determining a traffic participant is stopping when the speed is slowing and the location moves from a high heat moving index portion to a low moving heat index portion;

determining a traffic participant is parking when the speed is slowing, and the location moves from a low moving heat index portion to a high parking heat index portion; and determining a traffic participant is leaving a parking space when the speed is increasing, and the location moves from a low parking heat index portion to a low moving heat index portion.

6. The system of claim 5, further comprising providing an alert to traffic participants proximate to parking area when a traffic participant is leaving a parking space.

7. The system of claim 5, further comprising overlaying the heat map over a geographic map of the surface area.

8. The system of claim 7, further comprising displaying on the occupied parking spaces in a first manner and unoccupied spaces in a second manner on the heat map overlaying the geographic map.

* * * * *